United States Patent [19]

Sobat

[11] 3,942,607

[45] Mar. 9, 1976

[54] ELEVATOR SAFETY BRAKE

[76] Inventor: Dane Sobat, No. 1302, 808 - 5th St. SE, Calgary, Alberta, Canada

[22] Filed: Sept. 6, 1974

[21] Appl. No.: 503,933

[52] U.S. Cl. ..... 187/77; 187/69; 187/89; 188/189

[51] Int. Cl.[2] ..... B66B 5/22

[58] Field of Search ..... 187/73, 80, 89, 90, 91, 187/77, 78, 68, 69; 188/44, 61, 63, 127, 189

[56] References Cited

UNITED STATES PATENTS

| | | | |
|---|---|---|---|
| 613,628 | 11/1898 | Hadfield | 187/91 |
| 805,818 | 11/1905 | Regina | 187/89 |
| 950,477 | 3/1910 | Courtois | 187/89 X |
| 1,550,261 | 8/1925 | Jordan | 187/80 X |
| 3,601,227 | 8/1971 | Burch | 187/89 X |
| 3,872,949 | 3/1975 | Snyder | 187/89 |

*Primary Examiner*—Evon C. Blunk
*Assistant Examiner*—James L. Rowland
*Attorney, Agent, or Firm*—K. Maxwell Hill

[57] ABSTRACT

The accompanying specification discloses a mine cage safety device comprising at least one friction wheel adapted to roll freely over the shaft wall or mine cage guide timber when the cage is lifted upwards and downwards in the mine shaft. When the cage accelerates past a critical level as in a free fall the friction wheel actuates a hydraulic trigger means that in turn sets off an explosive charge which instantaneously drives braking means against the timber guides to thereby arrest the free fall of the mine cage.

4 Claims, 6 Drawing Figures

ELEVATOR SAFETY BRAKE

FIELD OF THE INVENTION

The present invention relates to a safety device for use with mine cage elevating apparatus and the like.

The principal object of the invention is to prevent free fall of a mine cage when a cable or other type of lifting mechanism fails to maintain the cage in normal controlled descent or ascent in a mine shaft.

Known mine cage safety devices rely for their actuation on the sensing of a break in the lifting cable and are designed to apply braking pressure mechanisims to the guides or walls of the mine shaft, thereby to arrest the free fall of the cage. In a number of recent disasters in mine shafts where men were injured and killed as a result of a cage falling, the known safety device did not operate when the cable broke, far up in the shaft a great distance from the cage or the winding mechanism was faulty, allowing the cable to run freely from its winding roll and the known safety device did not sense the break in the cable since the length of cable had itself great weight.

The principal object of the present invention is to provide an elevator safety device which will sense free fall of the cage by means of a friction wheel attached to the cage and running on the guide of the mine shaft. By sensing an increase in acceleration of the cage and by actuating a braking mechanism against the mine shaft guides or wall, the wheel of my invention results in an improved safety means for elevators long wanted in the art.

The friction wheel of the present invention operates a hydraulic pump mechanism which feeds hydraulic fluid under constant pressure to a triggering unit, provided the accelleration of the cage does not exceed a certain level. When the accelleration of the cage increases beyond a predetermined safety factor, the friction wheel increases the hydraulic pressure in the pump which higher pressure actuates the triggering mechanism. The triggering mechanism is combined with an explosively charged detonation means which propels plungers towards wedged brake shoes surrounding the guide means thereby to arrest the free fall of the mine cage.

SUMMARY OF THE INVENTION

The invention is, therefore, a means for preventing a mine cage from falling freely when the lowering means fails. It comprises in combination a rigid platform positioned between the two cage guide rails of the shaft and in the roof of the cage with a dust cover therearound to prevent the dirt from the mining operation from causing the safety device to interfere with its operation. An accelleration sensing wheel is fixed to a shaft held above the platform to roll freely along one of the guide rails as the cage is moved upwards or downwards in the shaft.

A piston arm is eccentrically mounted to the wheel and is connected to a hydraulic pump which pumps fluid at an increasing rate of pressure in direct relation to the speed of the wheel moving along the guide rail. A valve or tripping pump is inter-connected with the hydraulic pump means having a piston and tripping rod attached to it, such that when the wheel accellerates beyond a certain level the fluid pressure in the pump increases to a critial level in the tripping valve to drive a plunger outwardly from it to release the cocked arm of a trigger. The trigger releases a hammer which strikes a firing pin to set off an explosive charge in an enclosed chamber which results in ejection from the chamber along a barrel of a plunger mechanism to which are attached wedge shaped members which cooperate with a braking means that normally ride freely along the sides of the guiderails but are wedged against the guide rails by the action of the ejected plungers against the wedges.

It is known that the use of explosive charges in safety devices causes most rapid action; therefore, the sudden stoppage of the mine cage could possibly injure the persons riding therein, unless the stoppage is more gradually effected. I have, therefore, as a further object of this invention provided a delay means for descellerating the mine cage to prevent injury to persons riding in the cage. This delay means consists in having the firing trigger operate a first pair of brake shoes with smooth surfaces to ride on an straddle the rails simultaneous with the firing of the plunger which actuates the shoes. With the firing of the first set of plungers a timing lock is operated which after a few seconds actuates another explosive charge to move a pair of toothed brake shoes against another of the guide rails or timbers to arrest the fall of the cate. The teeth of the second pair of shoes bite into the timber of the guides to stope the cage instantaneously.

With the considerations and inventive objects herein set forth in view and such others as may become apparent from consideration of this disclosure and specification the present invention consists of and is hereby claimed to reside in the inventive concept which is comprised embodied embraced and included in the method, construction, arrangement, or combination of parts or new use of any of the foregoing which might herein be exemplified in one or more specific embodiments of such concept, reference being had to the accompanying drawings in which:

In the drawings like characters of reference designate similar parts of the several figures.

PREFERRED EMBODIMENT

Figure 1:
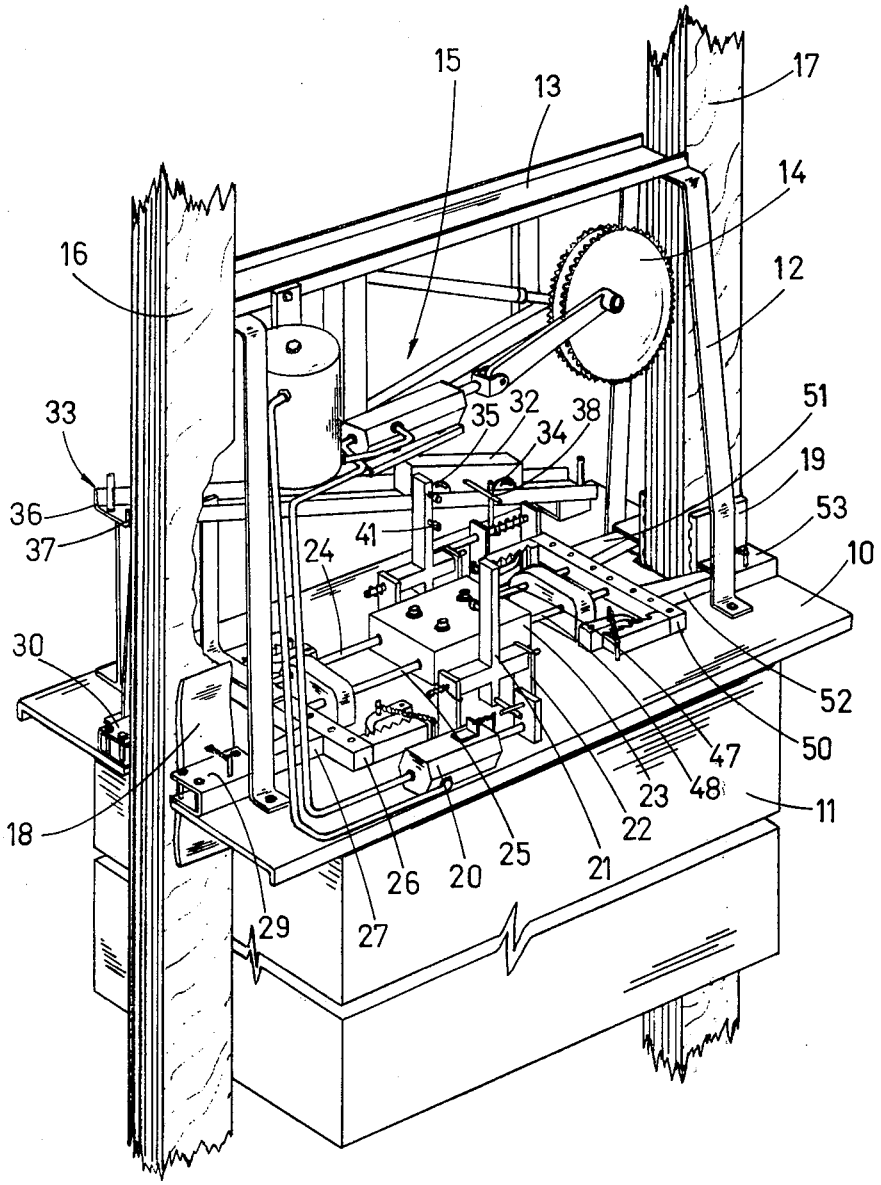
FIG. 1 is a perspective view of the invention shown attached to a platform which is positioned between the two guide timbers in a mine shaft and located on the roof of a mine cage.

In order first to describe briefly the present invention in terms consonent with those generally set forth in the accompanying Claim or Claims and to identify the parts defined therein the device is constructed generally as follows. In FIG. 1 a frame or platform 10 is positioned across the top of a mine cage 11 and has a frame member 12, 13 for holding and positioning the wheel member 14 and its accompanying hydraulics 15.

The mine cage and platform and frame assembly is shown riding freely and straddling a pair of mine shaft timbers 16, and 17. Shoes designated 18 and brakes designated 19 are shown freely riding in the normal position over the timbers 16 and 17, respectively. The hydraulic trigger valve 20 is associated with the firing pin 21 which is ridgidly fixed to the platform 10 at 22. An explosive or combustion detonation chamber 23 is fixed to the platform 10 and has four separate chambers in the shown device which has four separate firing pins. One pair of pins is fired together by trigger 21 which simultaneously explodes plungers 24, 25 towards guide 16. Attached to the end of the plungers 24, 25 is an arm 26 freely slideable over the platform 10 and pushing outwardly with it a pair of wedges 27, 28. Upon detonation and firing of the plungers wedges 27, 28 are forced into a wedge box 29 and 30 respectively, which mate with a pair of wedges formed with the shoes to force the shoes 18 against the guide 16.

Attached to the moveable rod member 26 is an upwardly extending finger 31 which holds a timing block 32 in an upward position on a track 33. The track 33 is fixed to the platform frame 10. As the member 26 is driven outwardly towards the guide the finger 31 releases the timing block 32 which is wheeled as at 34, 35 to ride in an track provided in 33 by a pair of rails 36, 37. A rod 38 is attached to the block and as the rod and block ride down the track the rod comes into contact with a release mechanism 40 which frees the second trigger arm 41 to strike the firing pins of the second pair of explosive charges confined in chamber 23 and drive plungers 47, 48 outwards toward the other guide rail 17. Attached to plungers 47, 48 is a freely riding cross member plate 50 having attached to its outwardly facing side a pair of wedge shaped members 51, 52. As the plungers carry them outwards, wedges 51, 52 drive into a pair of wedge blocks 53, 54 straddling the guide timber 17 each attached to one of the toothed shoes 19. Each wedge block combines a wedge which is formed with the brake 19, and as the wedge 52 drives forward into the wedge block the brake grips the guide.

Figure 2:
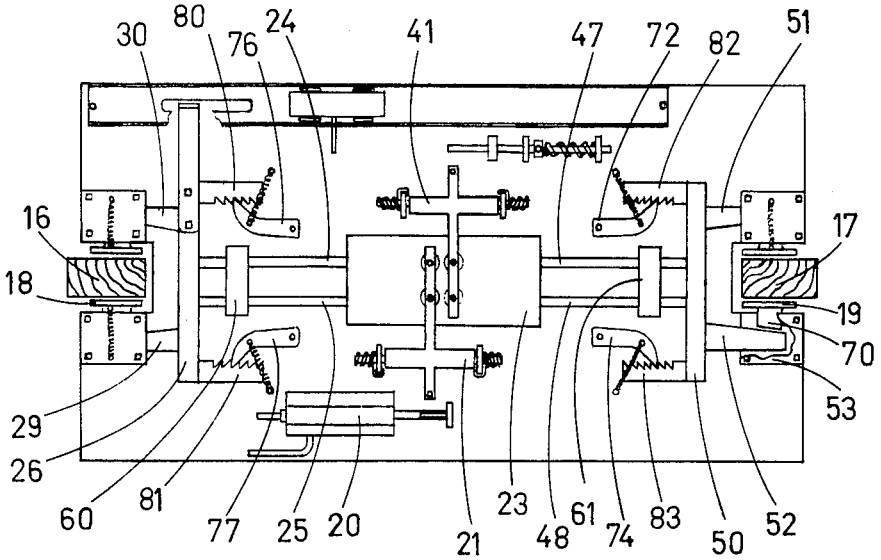
FIG. 2 is a plan view of the base of the platform frame holding the safety device showing the relative positions of the braking shoes, the firing pins, plungers and wedges.

The relative position of the parts shown in FIG. 2. where the combustion chamber 23 is centrally located of the device with the firing mechanisms 21 and 41 shown on either side of the compression chamber. Both triggers 41, 21 are shown in the fired position whereas FIG. 1 shows the firing mechanisms in the upright prefiring position. The pair of plungers 24, 25 are held together by a cross member 60 and plungers 47, 48 are held together by a guide cross member 61. Both 60 and 61 operate to guide the plunger uniformly along an axial path toward timbers 18, 17 respectively, and assist the force of the explosion from the chamber to be transmitted uniformly and insure that wedges 29, 30, 51 and 52 mate properly with the shoe wedge in the wedge blocks.

In FIG. 2 the wedge block surrounding wedge plunger 52 is shown cut away to indicate the method of contacting of the moveable wedge 52 against the fixed wedge 70 attached to shoe 19 within the wedge box 53. It will be seen that wedge 70 is integrally formed with the brake shoe 19, and assures that the force of the explosive action transmitted by the plungers to the rod 50 through the wedges 52 and 51 will be uniformly and directly contacted by the shoes and thereby transmitted uniformly towards the guide 17.

To ensure that the wedge and brake maintain the grasp against the guide and to resist the reaction of the guide back against the plungers and into the combustion chamber when the gases have been released from within the chamber, a pair of dogs 72, 74 are provided for arm 50 and a pair of dogs 76, 77 are provided for the rod 26 on the other side of the safety device. Each of the dogs 76, 77, 72 and 74 are fixed to the platform and are held in ratcheted engaging position with two ratchet means 80, 81, 82 and 83 which are each firmly held or formed with the free moving arms 26 and 50.

Figure 3:
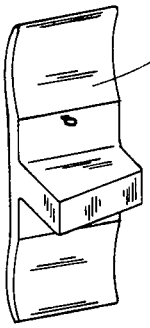
FIG. 3 is a smooth brake shoe.
Figure 4:
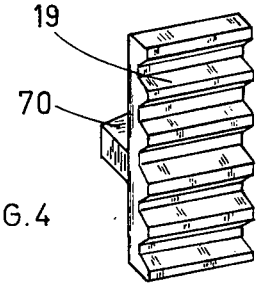
FIG. 4 is the perspective view of one of the second pairs of brake shoes which perform the final braking of the free falling cage.

After the safety device brings the cage to a halt the cage must be then lowered or the cable repaired before the dogs 76, 77, 72 and 74 are released to allow release of the wedge in the wedge box and the release for the brake. When the first pair of plungers are fired, a pair of shoes shown in FIG. 3 are forced against the guide 18 and retard the acceleration of the cage. A few seconds later by the action of the timing block the second firing mechanism operates which actuates the plungers and wedges to force the pair of toothed shoes as shown in FIG. 4 to grip firmly and hold the cage against the guide. The short delay provided by the timing delay device eliminates any sudden jar which might injure persons in the cage.

Figure 5:
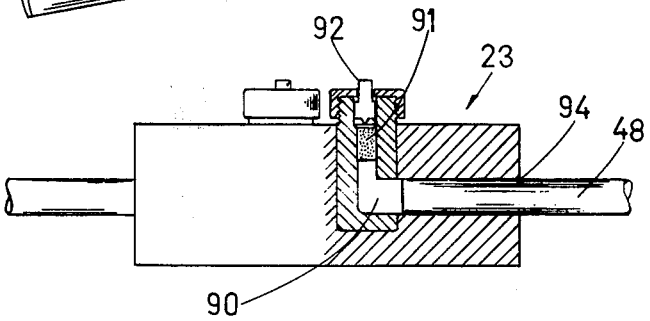
FIG. 5 shows a cartridge in position in the firing chamber and shows the positioning of a plunger prior to firing of the explosive charge.

In FIG. 5 the explosive chamber 23 is shown half cut away in section to show the chamber 90 within and the positioning of the plunger 48, positioned for firing from the barrel of the chamber 94. The explosive charge 91 is shown in position ready for firing and the firing pin 92 is also shown in section.

Figure 6:
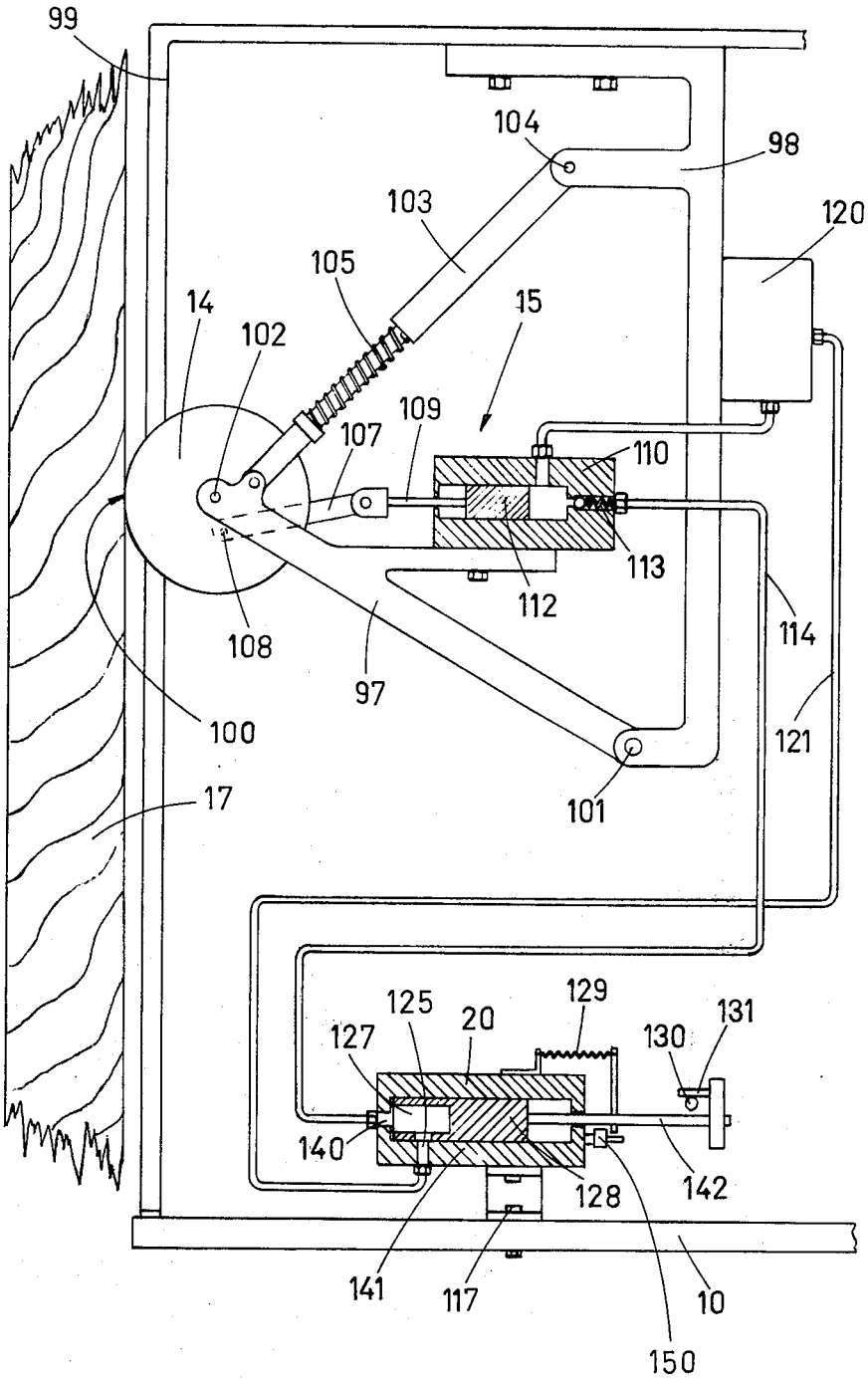
FIG. 6 shows an arrangement of a friction wheel operating a hydraulic pump which in turn operates the trigger valve.

The explosive means of the device described above will only operate when the cage is falling at a rate greater than that being deemed safe by those installing the safety device but the wheel mechanism as shown in FIG. 6 is designed to be operative at all times when the cage is moving upwards or downwards. The speed of the wheel is the initiating factor to determine when the safety portions of the device are to be activated. The wheel 14 runs freely on the guide timber 17 by contacting the timber as at point 100 shown in FIG. 6. The wheel protrudes through a dust cover 99, which dust cover is not shown in the FIG. 1, but is designed to keep dirt from falling on to the mechanism while the cage operates up and down the shaft in the mine.

The wheel is attached to a bracket 98 which is fastened to frame of the mine cage. The friction wheel is mounted on an arm 97 which is attached to the bracket 98 and is pivotally mounted as at 101 to the bracket. The wheel freely rotates as at 102 on the arm 97, the spring loaded arm 103 is pivotally attached to 98 as at 104 and is forced by means of a spring 105 against the rod 97. The spring loaded rod 103 keeps the friction wheel in contact with the guide rails and can be adjusted so that wear is not too severe at the surface of contact 100 between the wheel and guide 17 but will ensure that the wheel at all times does contact the the guide regardless of any warps or bends in the guide as the cage moves up and down thereby to ensure even constant and relatively uniform movement of the wheel when the cage passes over the rail.

A hydraulic piston mechanism 15 is associated with the friction wheel and comprises an eccentric arm 107 attached to the friction wheel 108 to provide reciprocating motion to the rod 107 and thereby reciprocating motion to a plunger 109 located in a hydraulic pump means 110. The rod 109 combines with piston 112 to pump hydraulic fluid past a valve 113 into a line 114 travelling to a hydraulic trigger valve 20. Valve 20 is fixed as at 117 to platform 10. A hydraulic reservoir 120 is provided in the system and has connected with it a return line 121 from the outlet of valve pump 20.

The pump 15 is designed to ensure that as the wheel 14 rides up and down freely at an accepted rate of speed fluid circulates through the system from 114 down to and through the triggering mechanism and freely through outlet port 125 and back up to the reservoir through line 1–21 in a uniform even manner. However, if the wheel should happen to ride faster along the rail the pump will operate more quickly and drive fluid through the inlet 140 into a chamber 127 formed in the head of piston 128 at a greater pressure. As the pressure mounts in the chamber 127 created on the piston head 128 tending to force it outwards of trigger barrel 141 and against the spring 129 allowing the piston rod 142 to move outwardly of barrel 141 carrying spring 129 with it. As the pressure increases which will in turn gradually close the outlet port 125 by movement of the piston 128 outwardly, the fluid volume will be decreased. The closing of the port 125 will increase the hydraulic pressure substantially more rapidly and resulting in the ejection outward against the reaction of the spring and thereby to release of the pin 130 which has been held down by the pin 131. Pin 130 is attached to the trigger 21 and release of the pin 130 will trigger the firing mechanism which will in turn explode the plungers from the combustion chambers against the wedge blocks and thereby create the braking to stop the cage from further acceleration.

The timing for triggering of the first set of explosive charges is achieved by means of a regulator means associated with the hydraulic triggering device 20 and consists of regulator nut 150 threadably attached to a rod. When the regulator nut is advanced outwardly of the rod it is forced against the spring 129, holding member which in turn draws out the piston rod 142 and piston 128 thereby restricting outlet port 125. Threading or adjusting the regulator 150 inwardly allows the outlet port passage to be enlarged to allow an increase in fluid volume to pass the trigger in turn to the reservoir 120.

When the desired volume of fluid is achieved to give the necessary triggering characteristic to the combination trigger, pump and wheel system the regulator nut 150 is locked by means of a suitable locknut or set screw means.

Various modifications may be made to the invention described and be within the scope of the concept disclosed. It is intended, therefore, the foregoing disclosure shall be considered as illustrative of such concept and not as limiting the protection sought to any particular embodiment thereof.

What is claimed is:

1. A braking device for an elevating apparatus operating within the walls of a shaft comprising in combination:

i. at least one wheel member rotatably mounted from said elevating apparatus against one of the walls of said shaft as said elevating device is moved upwardly or downwardly within said shaft;

ii. hydraulic means operated by movement of said wheel member to pump fluid at increasing pressure to a trigger device supported on a platform of said elevating apparatus;

iii. an explosion containing chamber having an explosive charge therein fixed to said elevating apparatus adapted to drive an ejection member therefrom upon release of said trigger to explode a charge contained by said chamber, said trigger actuated by increase of fluid pressure from said hydraulic means;

iv. brake members expandable from said platform against said shaft walls by said ejection means to arrest movement of said elevating device within said shaft.

2. A braking device for an elevating apparatus as claimed in claim 1 wherein said elevating apparatus operates between two guide rails fixed within said shaft and wherein said wheel member is rotatably mounted on a frame supported by said platform, against one of said guide rails as the elevating apparatus is moved upwardly or downwardly of said shaft, and wherein said brake members comprise a pair of brake shoes expandable outwardly of said platform to said one of said guide rails by said ejection member exploded from said chamber.

3. A safety device as claimed in claim 2 wherein said wheel rotatably mounted on said elevating apparatus comprises a friction wheel fixed to a frame and freely moveable along one of said guide rails as said apparatus is moved upwards or downwards along said guide rails, and having a piston arm eccentrically mounted to said wheel and connected to a hydraulic pump means to pump fluid at increasing pressure as said wheel is moved more rapidly along said guide rails by increasing acceleration of said elevating device, a valve means interconnected with said pump means adapted to release a tripping rod when pressure increases in said pumping system beyond a predetermined level and wherein said tripping rod actuates said trigger means to fire the explosive charge to actuate the ejection member.

4. A safety device as claimed in claim 2 having a first ejection member acting against a wedge to force a pair of smooth brake shoes against one of said guide rails to decelerate the elevating device and having a delay means associated with said first ejection member to trigger and fire a second explosive charge to eject a second ejection member against a wedge forcing a second pair of brake shoes against the second rail to quickly arrest the fall of said elevating apparatus in said shaft.

* * * * *